US005286591A

United States Patent [19]

Hongo

[11] Patent Number: 5,286,591

[45] Date of Patent: Feb. 15, 1994

[54] ELECTROPHOTOGRAPHIC PHOTORECEPTOR WITH SUBBING LAYER

[75] Inventor: Kazuya Hongo, Minami-ashigara, Japan

[73] Assignee: Fuji Xerox Co., Ltd., Tokyo, Japan

[21] Appl. No.: 909,766

[22] Filed: Jul. 7, 1992

[30] Foreign Application Priority Data

Jul. 10, 1991 [JP] Japan ..... 3-196011

[51] Int. Cl.[5] ..... G03G 5/14

[52] U.S. Cl. ..... 430/60; 430/62; 430/64

[58] Field of Search ..... 430/60, 62, 64

[56] References Cited

U.S. PATENT DOCUMENTS 5,091,278 2/1992 Teuscher et al. ..... 430/64 X
5,188,916 2/1993 Hodumi et al. ..... 430/60 X

FOREIGN PATENT DOCUMENTS 145251 6/1987 Japan ..... 430/64
273547 11/1987 Japan ..... 430/64
273568 11/1987 Japan ..... 430/64
64-44450 2/1989 Japan .
136163 5/1989 Japan ..... 430/60
243075 9/1989 Japan ..... 430/64
2-87154 3/1990 Japan .
2-287232 11/1990 Japan .
298953 12/1990 Japan ..... 430/60
3-23464 1/1991 Japan .

*Primary Examiner*—Roland Martin
*Attorney, Agent, or Firm*—Oliff & Berridge

[57] ABSTRACT

An electrophotographic photoreceptor is disclosed, comprising an electrically conductive substrate having thereon a subbing layer and a photosensitive layer, wherein the subbing layer contains (a) an organic chelate compound or an organic alkoxide compound and (b) a hygroscopic compound having at least two carboxyl groups per molecule. The subbing layer does not increase its volume resistance even on repeated use in a low humidity condition so that the photoreceptor has a small residual potential to provide satisfactory images with excellent durability.

6 Claims, No Drawings

ELECTROPHOTOGRAPHIC PHOTORECEPTOR WITH SUBBING LAYER

FIELD OF THE INVENTION

This invention relates to an electrophotographic photoreceptor comprising an electrically conductive substrate, a subbing layer, and a photosensitive layer. More particularly, it relates to an electrophotographic photoreceptor having an improved subbing layer.

BACKGROUND OF THE INVENTION

Known photoconductive substances to be used in electrophotographic photoreceptors include various organic and inorganic photoconductive substances. Organic photoconductive substances hold advantages, such as satisfactory film-forming properties, capability of providing a transparent and flexible film, and low cost. However, they are inferior to inorganic photoconductive substances in sensitivity and durability. In case of using an organic photoconductive substance, therefore, it has been proposed to improve sensitivity and durability by using a so-called separate function, lamination type electrophotographic photoreceptor composed of a charge generating layer and a charge transporting layer.

In general, the state-of-the-art electrophotographic photoreceptors are known to have any of disadvantages, such as (1) poor stability of image contrast against repeated use or environmental change, (2) liability to image defects called white spot, black spot, coarse image, pinhole, etc., and (3) insufficient durability due to low adhesive strength between a substrate and a photosensitive layer, causing separation of the photosensitive layer during use.

In order to eliminate these disadvantages, it has been proposed to provide a subbing layer comprising a resin between a substrate and a photosensitive layer. Included in known resins for the subbing layer are poly-p-xylene, casein, polyvinyl alcohol, phenolic resins, polyvinyl acetal resins, melamine resins, nitrocellulose, ethylene-acrylic acid copolymers, polyamide (e.g., nylon 6, nylon 66, nylon 610, copolymer nylon, alkoxymethylated nylon), polyurethane, gelatin, polyvinyl pyrrolidone, polyvinyl pyridine, and polyvinyl methyl ether.

It has also been proposed to form a subbing layer using organozirconium compounds, e.g., zirconium chelate compounds and zirconium alkoxides, or silane coupling agents as disclosed in Japanese patent application No. 2-287232.

What is aimed at by providing a resin layer as a subbing layer is to control volume resistance at such a low level that does not deteriorate electrophotographic characteristics by chiefly using a resin having a relatively large content of a polar group. Since volume resistance of a resin has character of being dependent on ionic conduction, it is considerably influenced by temperature and humidity. That is, when a photoreceptor is exposed to a low temperature and low humidity condition or a high temperature and high humidity condition, the resin layer has markedly increased resistance, leading to deterioration of electrophotographic characteristics of the photosensitive layer, or markedly decreased resistance, leading to loss of functions expected, respectively.

Thus, it was only part of the above-described disadvantages associated with a photoreceptor that has been improved by the conventionally known resin layer. Susceptibility to environmental influences being taken into consideration, the effects of the resin layer are reduced by half. Therefore, the conventional resin layers have been extremely insufficient from the technical consideration.

Where an organozirconium compound (e.g., a zirconium chelate compound or a zirconium alkoxide) or a silane coupling agent is employed either alone or in combination with a binder resin, and particularly where a photoreceptor is under a low temperature and low humidity condition, the volume resistance increases due to evaporation of the water content having been adsorbed into the resin layer, and the development contrast decreases with an increase in residual potential. This easily causes image defects, such as white spot, black spot, coarse image, and pinhole.

In this connection, JP-A-64-44450 (the term "JP-A" as used herein means an "unexamined published Japanese patent application") teaches incorporation of a wetting agent comprising a polyhydric alcohol into a charge generating layer or a subbing layer so as to prevent the layer from increasing its volume resistance even at a low humidity, and JP-A-3-23464 proposes incorporation of polyethylene glycol into a subbing layer. Nevertheless, the water retaining properties of polyhydric alcohols or polyethylene glycol are not enough to sufficiently prevent an increase of volume resistance of the subbing layer when continuously used under a low humidity condition.

On the other hand, where a photoreceptor is used in a laser printer in which an electrostatic latent image is formed using coherent light, such as a semi-conductor laser, as a light source, an interference fringe appears on the printed image due to the interference between the reflected light on the surface of the photoreceptor and that on the surface of the substrate. This can be avoided by roughening the surface of the substrate to thereby reduce the reflection on the substrate. In this case, if a subbing layer formed on the roughened surface of the substrate has a small thickness, it is very likely that charges are injected through the uneven subbing layer to cause image defects, such as black spots or white spots. Therefore, in using a surface-grained substrate, the thickness of the subbing layer to be formed thereon must have its thickness relatively increased by addition of a resin component.

However, where a subbing layer having a relatively large thickness contains an organic chelate compound as described above, it would have an increased content of a reaction residue resulting from the organic chelate compound (mostly an oxygen bond), which gives rise to the problem that the volume resistance of the subbing layer tends to increase especially under a low humidity condition.

A known countermeasure to overcome the problem associated with the use of an organic chelate compound in a thick subbing layer is to allow a photoreceptor produced to stand at a given humidity for several hours to several days thereby to decrease the reaction residue in the subbing layer and to stabilize the characteristics of the photoreceptor.

SUMMARY OF THE INVENTION

An object of the present invention is to provide an electrophotographic photoreceptor whose subbing layer is prevented from increasing its volume resistance even when continuously used under a low humidity condition so that the photoreceptor may have a low residual potential, satisfactory image quality, and excellent durability.

Another object of the present invention is to provide an electrophotographic photoreceptor which produces high quality images free from an interference fringe when used in a laser printer using coherent light.

As a result of investigations, the inventors have found that a subbing layer containing a hygroscopic agent having at least two carboxyl groups per molecule maintains a constant water content irrespective of the environment and is thereby less liable to variation of volume resistance. It has also been found that the above-described compound having at least two carboxyl groups per molecule destroys the terminal of the reaction residue of organic chelate compounds present in the subbing layer. As a result, the content of the organic chelate compound reaction residue in the subbing layer can always be controlled, and the photoreceptor can be prevented from increasing its residual potential under a low humidity condition.

That is, the present invention relates to an electrophotographic photoreceptor comprising a conductive substrate having thereon a subbing layer and a photosensitive layer, wherein said subbing layer contains (a) an organic chelate compound or an organic alkoxide compound and (b) a hygroscopic compound having at least two carboxyl groups per molecule.

DETAILED DESCRIPTION OF THE INVENTION

The conductive substrate which can be used in the present invention is not limited. If desired, the conductive substrate may be subjected to any surface treatment, such as anodizing, surface roughening by liquid honing, a treatment with a chemical, or a coloration, as long as image quality is not impaired thereby.

In the present invention, it is preferred to rough the surface of the substrate by honing. The term "rough" as used herein means that the surface of the substrate has a centerline average roughness (Ra) of from 0.1 to 2.0 μm, particularly from 0.1 to 0.5 μm.

On the conductive substrate is coated a subbing layer. The subbing layer according to the present invention comprises an organic chelate compound or an organic alkoxide compound and a hygroscopic compound having at least two carboxyl groups per molecule.

The hygroscopic compound to be used in the present invention exhibits high water retention owing to its two or more carboxyl groups and serves as a water absorbing agent. Typical examples of such hygroscopic compound include oxalic acid, malonic acid, glutaric acid, succinic acid, adipic acid, phthalic acid, fumaric acid, maleic acid, tartaric acid, malic acid, cyclohexanone-1,2-dicarboxylic acid, benzene-1,3,5-tricarboxylic acid, polyacrylic acid, polymethacrylic acid, an ethylene-acrylic acid copolymer, a vinyl chloride-acrylic acid copolymer, and derivatives of these compounds obtained by substitution with a halogen atom, a hydroxyl group, a nitro group, an alkyl group, an amino group, a phenyl group, or a like substituent. Of these, cyclohexanone-1,2-dicarboxylic acid and benzene-1,3,5-tricarboxylic acid are particularly preferred. These hygroscopic compounds may be used either individually or in combination of two or more thereof. Incidentally, compounds having not more than 1 carboxyl group per molecule produce insufficient effects due to the poorer water retention.

The hygroscopic compound is present in the subbing layer in an amount of from about 0.01 to 10% by weight, and preferably from 0.1 to 5% by weight, based on the solids content of the subbing layer. If its amount is less than about 0.01% by weight, no moisture retaining effect can be obtained. The level of addition exceeding about 10% by weight not only deteriorates the film-forming properties of the subbing layer coating composition but reduces adhesion to a substrate, easily causing separation of the photosensitive layer on use.

The organic chelate compound or organic alkoxide compound which can be used in the subbing layer include organozirconium compounds such as zirconium tetrabutoxide, tetrakisacetylacetonatozirconium, dipropoxydiacetyl-acetonatozirconium, tributoxyacetyl-acetonatozirconium, etc., organic titanate compounds such as isopropyltriisostearoyl titanate, dicumylphenyloxyacetate titanate, etc., organic indium compounds such as indium-mono-acetylacetonato-di-isopropylate, indium-tri-isopropylate, etc., and organic aluminum compounds such as ethyl acetoacetate aluminum-di-isopropylate, etc. Among these, organozirconium compounds, particularly acetylacetonato zirconium compounds are preferred.

The organic chelate compound or organic alkoxide compound is present in the subbing layer in an amount of preferably from 20 to 95% by weight, and more preferably from 50 to 90% by weight, based on the solids content of the subbing layer.

The subbing layer of the present invention may further comprise a binder resin and/or a silane coupling agent. The silane coupling agent in the subbing layer undergoes bonding with an oxygen bond resulting from the curing reaction of the chelate compound to form a three-dimensional network. The silane coupling agent thus serves to increase the film strength of the subbing layer.

Examples of suitable binder resins includes polyvinyl acetal, polyvinyl alcohol, phenol resins, alcohol-soluble polyamide, copolymer nylon, cellulose resins, polyvinyl pyrrolidone, polyvinyl pyridine, polyvinyl methyl ether, ethylene-acrylic ester copolymers, polyester, polycarbonate, polyvinyl butyral, polystyrene, polyurethane, polypropylene, polyacrylate, polyarylate, poly-p-xylene, polyimide resins, vinylidene chloride resins, vinyl chloride-vinyl acetate copolymers, casein, and gelatin.

The amount of the binder resin to be added is selected appropriately depending on the desired thickness of the subbing layer.

Typical examples of suitable silane coupling agents are vinyltrichlorosilane, vinyltrimethoxysilane, vinyltriethoxy-silane, vinyl-tris(2-methoxyethoxy)silane, vinyltriacetoxy-silane, γ-glycidoxypropyltrimethoxysilane, γ-methacryloxy-propyltrimethoxysilane, γ-aminopropyltriethoxysilane, chloropropyltrimethoxysilane, γ-2-aminoethylpropyl-trimethoxysilane, γ-mercaptopropyltrimethoxysilane, γ-ureidopropyltriethoxysilane, and β-3,4-epoxycyclohexylethyl-trimethoxysilane.

The organic metal chelate compound and the silane coupling agent are preferably mixed at a Metal/Si molar ratio ranging from 1/1 to 5/1. If the metal ratio is greater than the above range, the subbing layer has poor wetting when coated with a charge generating layer coating composition only to form an uneven coating film. If the Si ratio is greater than the above range, a residual potential would be increased.

The subbing layer of the present invention has a thickness usually of from 0.01 to 5 μm, and preferably from 0.5 to 2 μm.

The coating composition for a subbing layer is prepared by dissolving the above-described components in a solvent, such as alcohols, e.g., ethanol, methanol, propanol, and butanol; ketones, e.g., acetone and methyl ethyl ketone; aromatic hydrocarbon, e.g., toluene and xylene; esters, e.g., ethyl acetate and cellosolve acetate; or mixtures thereof.

The coating composition is coated by, for example, dip coating, spray coating, blade coating, spinner coating, bead coating, curtain coating, etc. Drying of the coating is carried out in an air flow or in still air at a temperature ranging from 10° to 200° C., and preferably from 30° to 180° C., for a period of from 5 minutes to 6 hours, and preferably from 10 minutes to 2 hours.

On the thus formed subbing layer is provided a photosensitive layer having a laminate structure composed at least of a charge generating layer and a charge transporting layer. The order of laminating these layers is arbitrary.

The charge generating layer is formed by coating a dispersion of a charge generating material in an appropriate solvent, which may contain, if desired, an appropriate binder resin, and drying.

Any of known charge generating materials may be employed. Binder resins which can be used in the charge generating layer are conventional and include polycarbonate, polystyrene, polyester, polyvinyl butyral, methacrylic ester polymers, vinyl acetate homo- or copolymers, cellulose esters or ethers, polybutadiene, polyurethane, and epoxy resins.

A mixing ratio of the charge generating material to the binder resin usually ranges from 40:1 to 1:4 by weight, and preferably from 20:1 to 1:2 by weight. If the ratio of the charge generating material is too high, the coating composition has reduced stability. If it is too low, the sensitivity of the layer is reduced.

The solvent to be used in the coating composition for the charge generating layer includes methanol, ethanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, benzene, toluene, xylene, chlorobenzene, dimethylformamide, dimethylacetamide, and mixtures of these organic solvents.

The charge generating layer usually has a thickness of from about 0.01 to 5 μm, and preferably from 0.03 to 2 μm.

The charge transporting layer is formed by coating a solution of a charge transporting material and a film-forming binder resin in an appropriate solvent. The charge transporting material to be used is not particularly limited, and any of known materials may be used. Examples of suitable binder resins are polycarbonate, polyarylate, polyester, polystyrene, styrene-acrylonitrile copolymers, polysulfone, polymethacrylic esters, styrene-methacrylic ester copolymers, and polyolefins. Preferred of them is polycarbonate Z, a kind of polycarbonate resins.

The mixing ratio of the charge transporting material to the binder resin usually ranges from 5:1 to 1:5 by weight, and preferably from 3:1 to 1:3 by weight. If the ratio of the charge transporting material is too high, the layer has reduced mechanical strength. If it is too low, the sensitivity is reduced. Where the charge transporting material used has film-forming properties by itself, a binder resin may not be used.

The coating composition is coated by a commonly employed method, such as blade coating, wire bar coating, spray coating, dip coating, bead coating, or curtain coating. The charge transporting layer usually has a thickness of from 5 to 50 μm, and preferably from 10 to 40 μm.

If desired, a protective layer may be provided on the thus formed photosensitive layer to improve printing durability.

While the electrophotographic photoreceptor according to the present invention is effectively used in electrophotographic copying machines, it is also applicable to a laser beam printer, an LED printer, a CRT printer, a microfilm reader, an electrophotographic plate making system, and the like According to the present invention, the subbing layer containing a hygroscopic compound absorbs and retains moisture thereby to prevent excessive drying of the photoreceptor. Further, the subbing layer is prevented from increasing its volume resistance by virtue of the low resistance of the hygroscopic compound present therein. The charge transfer behavior in the subbing layer can thus be controlled under a low humidity condition. On account of such a mechanism, the electrophotographic photoreceptor of the present invention exhibits satisfactory electrophotographic characteristics while maintaining excellent image contrast against repeated use and environmental changes.

In addition, even when a thick subbing layer is formed on a substrate having been subjected to a surface roughening treatment, such as liquid honing, the hygroscopic compound in the subbing layer is effective to control the reaction residue of the organic chelate compound. Therefore, the photoreceptor can be prevented from increasing its residual potential under a low humidity condition.

The present invention is now illustrated in greater detail with reference to Examples, but it should be understood that the present invention is not construed as being limited thereto. All the parts and percents are by weight unless otherwise indicated.

EXAMPLE 1 AND COMPARATIVE EXAMPLES 1 TO 3

In 90 g of methanol was dissolved 10 g of an alcohol-soluble copolymer nylon resin ("CM-4000" produced by Toray Industries, Inc.), and to the solution was added 0.5 g of malonic acid as a hygroscopic compound having two carboxyl groups per molecule to prepare a coating composition for a subbing layer.

The composition was coated on the surface of an aluminum cylinder having a diameter of 84 mm and a length of 310 mm by means of a ring coater to a dry thickness of about 0.5 μm and dried by heating at 135° for 10 minutes to form a subbing layer.

A 5% cyclohexanone solution of a polyvinyl butyral resin ("S-Lec BM-2" produced by Sekisui Chemical Co., Ltd.) was prepared. To 20 parts of the resulting solution was added 8 parts of a bromoanthanthorone pigment (C.I. Pigment Red 168), followed by dispersing in a sand mill for 5 hours. To the dispersion was added 60 parts of cyclohexanone to prepare a dip coating composition.

The aluminum cylinder having thereon the subbing layer was then dip-coated with the coating composition and dried by heating at 100° C. for 10 minutes to form a 1.0 μm thick charge generating layer.

Four parts of N,N'-diphenyl-N,N'-bis(3-methylphenyl)-[1,1'-biphenyl]-4,4'-diamine and 6 parts of polycarbonate Z were dissolved in 40 parts of monochlorobenzene to prepare a coating composition for a charge transporting layer. The composition was coated on the charge generating layer by dip coating and dried by heating at 115° C. for 60 minutes to form a 20 μm thick charge transporting layer.

A comparative electrophotographic photoreceptor was prepared in the same manner as described above, except for replacing malonic acid with the same amount of propionic acid having one carboxyl group per molecule (Comparative Example 1), or using no malonic acid in the subbing layer (Comparative Example 2).

Each of the thus obtained electrophotographic photoreceptors was charged to −5.5 kV by means of a corotron discharger (process A). One second later, the photoreceptor was exposed to white light of 9.0 erg/cm$^2$ for discharge (process B). Three seconds later, it was exposed to green light of 50 erg/cm$^2$ for destaticizing (process C). The surface voltage of the photoreceptor was measured for each process. All the measurements were conducted under a condition of 28° C., 85% RH (condition I) or a condition of 10°, 15% RH (condition II). The results obtained are shown in Table 1 below. The higher the initial surface voltage ($V_H$) of process A, the higher the chargeability of the photoreceptor, indicating higher capacity of potential contrast. The lower the residual potential ($V_L$) of process B, the higher the photosensitivity. The lower the residual potential ($V_{RP}$) of process C, the less the liability to image memory or fog. The same measurements were also made after repeating processes A to C 5000 times.

Further, the photoreceptor was mounted on a copying machine ("FX 2700" manufactured by Fuji Xerox Co., Ltd.), and a running test was conducted to obtain 100,000 copies under condition I or II. The image quality of the copies after the running test was evaluated. The results of the evaluation are shown in Table 1.

TABLE 1

| Example No. | Hygroscopic Compound (Amount; g) | Measurement Condition | Initial Stage $V_H$ (V) | Initial Stage $V_L$ (V) | Initial Stage $V_{RP}$ (V) | After 5000 times Repetition $V_H$ (V) | After 5000 times Repetition $V_L$ (V) | After 5000 times Repetition $V_{RP}$ (V) | Image Quality After Running Test |
|---|---|---|---|---|---|---|---|---|---|
| Example 1 | malonic acid | I | −820 | −140 | −20 | −830 | −160 | −40 | clear |
| | (0.6) | II | −830 | −150 | −30 | −840 | −180 | −50 | clear |
| Comparative | propionic | I | −820 | −140 | −20 | −860 | −170 | −60 | white spot occurs |
| Example 1 | acid (0.5) | II | −840 | −160 | −50 | −870 | −190 | −90 | many white spots occur |
| Comparative | none | I | −820 | −140 | −20 | −860 | −170 | −60 | white spot occurs |
| Example 2 | | II | −840 | −160 | −50 | −880 | −200 | −100 | many white spots occur |

As is apparent from the results in Table 1, the photoreceptor of Comparative Example 2 containing no malonic acid underwent a great increase in potential in the low humidity condition (condition II) and also a considerable increase in potential after charging 5000 times. Moreover, after the running test, the image obtained suffered from white spots under the high temperature and high humidity condition (condition I), or many fine white spots under the low humidity condition (condition II). The photoreceptor of Comparative Example 1 using propionic acid in place of malonic acid showed no effect on preventing an increase in potential in the low humidity condition.

EXAMPLE 2 AND COMPARATIVE EXAMPLE 3

A hundred parts of a 50% toluene solution of tributoxyacetylacetonatozirconium ("ZC 540" produced by Matsumoto Kosho K.K.), 11 parts of γ-aminopropyltrimethoxysilane ("A 1110" produced by Nippon Unicar Co., Ltd.), 440 parts of isopropyl alcohol, and 220 parts of n-butyl alcohol were mixed. To the mixture was added 1 part of phenylsuccinic acid as a hygroscopic compound, and the mixture was stirred in a stirrer to prepare a coating composition for a subbing layer.

The composition was coated on an aluminum substrate in the same manner as in Example 1 and dried by heating at 175° C. for 10 minutes to form a subbing layer having a thickness of 0.1 μm.

A charge transporting layer and a charge generating layer were laminated thereon in the same manner as in Example 1 to obtain an electrophotographic photoreceptor.

For comparison (Comparative Example 3), an electrophotographic photoreceptor was produced in the same manner as described above, except for using no phenylsuccinic acid in the subbing layer.

Each photoreceptor was tested in the same manner as in Example 1. The results obtained are shown in Table 2.

TABLE 2

| Example No. | Hygroscopic Acid | Measurement Condition | Initial Stage $V_H$ (V) | Initial Stage $V_L$ (V) | Initial Stage $V_{RP}$ (V) | After 5000 times Repetition $V_H$ (V) | After 5000 times Repetition $V_L$ (V) | After 5000 times Repetition $V_{RP}$ (V) | Image Quality After Running Test |
|---|---|---|---|---|---|---|---|---|---|
| Example 2 | phenyl | I | −820 | −130 | −20 | −830 | −140 | −40 | clear |
| | succinic acid | II | −830 | −140 | −30 | −840 | −160 | −50 | clear |
| Comparative | none | I | −820 | −140 | −20 | −840 | −170 | −40 | clear |
| Example 3 | | II | −840 | −170 | −60 | −880 | −210 | −120 | many white spots occur |

It can be seen from the results in Table 2 that the comparative photoreceptor containing no hygroscopic compound in the subbing layer underwent a great increase in potential in the low humidity condition, and the potential increase after repetition of charging 5000 times was also considerable. The image obtained after the running test suffered from many fine white spots in the low humidity condition.

EXAMPLE 3 AND COMPARATIVE EXAMPLE 4

A mirror-surfaced aluminum pipe having a diameter of 40 mm and a length of 319 mm was subjected to wet honing according to the disclosure of JP-A-2-87154. In a liquid honing apparatus, an aqueous suspension of 10 kg of an abrasive ("Green Densic GC #400" produced by Showa Denko K.K.) in 40 l of water was fed to a gun at a rate of 6 l/min and sprayed onto the aluminum pipe at a spray speed of 60 mm/min and an air pressure of 0.85 kgf/cm$^2$ while rotating the substrate at 100 rpm and moving it in the axial direction. The thus finished aluminum pipe had a centerline average roughness (Ra) of 0.15 μm.

In 152 parts of n-butyl alcohol was dissolved 8 parts of polyvinyl butyral ("S-Lec BM-S" produced by Sekisui Chemical Co., Ltd.) with stirring to prepare a 5% polyvinyl butyral solution. A mixture of 113 parts of a 50% toluene solution of tributoxyacetylacetonatozirconium ("ZC 540"), 15 parts of γ-aminopropyltrimethoxysilane ("A 1110"), and 111 parts of n-butyl alcohol was added to the above prepared polyvinyl butyral solution. To the mixture was added 1 part of benzene-1,3,5-tricarboxylic acid as a hygroscopic compound, and the mixture was stirred in a stirrer to prepare a coating composition for a subbing layer.

The composition was coated on the aluminum substrate in the same manner as in Example 1 and dried by heating at 175° C. for 10 minutes to form a subbing layer having a thickness of 1.0 μm.

In 100 parts of cyclohexanone was dissolved 3 parts of polyvinyl butyral ("S-Lec BM-1" produced by Sekisui Chemical Co., Ltd.), and 3 parts of X-type metal-free phthalocyanine was added to the solution. The mixture was dispersed in a sand mill for 20 hours and then diluted with cyclohexanone to prepare a coating composition for a charge generating layer having a solid content of 3.5%. The coating composition was coated on the subbing layer by means of a ring coater and dried at 100° C. for 10 minutes to form a 0.3 μm thick charge generating layer.

A charge transporting layer was formed on the charge generating layer in the same manner as in Example 1 to obtain an electrophotographic photoreceptor.

For comparison, an electrophotographic photoreceptor was produced in the same manner as described above, except for using no benzene-1,3,5-tricarboxylic acid in the subbing layer.

Each photoreceptor was charged with a scorotron discharger at a grid applied voltage of −700 V (process A). One second later, the charged photoreceptor was exposed to light of 29.0 erg/cm$^2$ emitted from a semiconductor laser (780 nm) for discharge (process B). Three seconds later, the photoreceptor was further exposed to red light of 50 erg/cm$^2$ for destaticizing (process C). The surface voltage of the photoreceptor was measured for each process was measured in the same manner as in Example 1. The same measurements were also made after repeating processes A to C 5000 times. The results obtained are shown in Table 3 below.

Further, the photoreceptor was mounted on a laser printer ("XP-11" manufactured by Fuji Xerox Co., Ltd.), and a running test was conducted to obtain 100,000 prints under condition I or II. The image quality of the prints after the running test was evaluated. The results of the evaluation are shown in Table 3.

TABLE 3

| Example No. | Hygroscopic Acid | Measurement Condition | Initial Stage $V_H$ (V) | Initial Stage $V_L$ (V) | Initial Stage $V_{RP}$ (V) | After 5000 times Repetition $V_H$ (V) | After 5000 times Repetition $V_L$ (V) | After 5000 times Repetition $V_{RP}$ (V) | Image Quality After Running Test |
|---|---|---|---|---|---|---|---|---|---|
| Example 3 | benzene-1,3,5-tricarboxylic acid | I | −630 | −140 | −30 | −640 | −150 | −50 | clear |
| | | II | −640 | −150 | −40 | −650 | −170 | −60 | clear |
| Comparative Example 4 | none | I | −630 | −150 | −40 | −650 | −180 | −60 | clear |
| | | II | −650 | −170 | −70 | −680 | −220 | −140 | many black spots occur |

As is apparent from the results in Table 3, the photoreceptor of Comparative Example 4 containing no benzene-1,3,5-tricarboxylic acid underwent a great increase in potential in the low humidity condition (condition II) and also a considerable increase in potential after charging 5000 times. Moreover, after the running test, the prints obtained suffered from many black spots (fog) under the low humidity condition (condition II).

The photoreceptor of Example 3, in which the substrate had received a liquid honing treatment, produced high quality images, indicating the uniformity of the subbing layer.

As described above, since the subbing layer contains a hygroscopic compound, the electrophotographic photoreceptor according to the present invention is prevented from increasing its residual potential in a low humidity condition and therefore exhibits excellent durability irrespective of the environmental condition.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having thereon a subbing layer and a photosensitive layer, wherein said subbing layer contains (a) an organic metal chelate compound or an organic metal alkoxide compound and (b) a hygroscopic compound having at least two carboxyl groups per molecule, wherein said hygroscopic compound is present in an amount of from 0.01 to 10% by weight based on the solids content of the subbing layer.

2. An electrophotographic photoreceptor as claimed in claim 1, wherein said subbing layer further contains a silane coupling agent.

3. An electrophotographic photoreceptor as claimed in claim 1, wherein said subbing layer further contains a binder resin.

4. An electrophotographic photoreceptor as claimed in claim 1, wherein said organic chelate compound is an acetylacetonato compound.

5. An electrophotographic photoreceptor as claimed in claim 1, wherein said substrate has a roughened surface.

6. An electrophotographic photoreceptor as claimed in claim 5, wherein said roughened surface of the substrate is a surface obtained by honing.

* * * * *